US005245832A

United States Patent [19]

Roberts

[11] Patent Number: 5,245,832

[45] Date of Patent: Sep. 21, 1993

[54] TRIPLE COLUMN CRYOGENIC RECTIFICATION SYSTEM

[75] Inventor: Mark J. Roberts, North Tonawanda, N.Y.

[73] Assignee: Praxair Technology, Inc., Danbury, Conn.

[21] Appl. No.: 871,031

[22] Filed: Apr. 20, 1992

[51] Int. Cl.[5] ..... F25J 3/02

[52] U.S. Cl. ..... 62/24; 62/22; 62/23; 62/41

[58] Field of Search ..... 62/22, 23, 24, 41

[56] References Cited

U.S. PATENT DOCUMENTS

| | | | |
|---|---|---|---|
| 3,688,513 | 9/1972 | Streich et al. | 62/22 |
| 4,433,990 | 2/1984 | Olszewski | 62/22 |
| 4,507,134 | 3/1985 | Tomisaka | 62/30 |
| 4,578,095 | 3/1986 | Erickson | 62/22 |
| 4,705,548 | 11/1987 | Agrawal et al. | 62/22 |
| 4,747,860 | 5/1988 | Atkinson | 62/22 |
| 4,755,202 | 7/1988 | Cheung | 62/17 |
| 4,783,209 | 11/1988 | Erickson | 62/22 |
| 4,822,395 | 4/1989 | Cheung | 62/22 |
| 4,838,913 | 6/1989 | Victor et al. | 62/22 |
| 4,883,516 | 11/1989 | Layland et al. | 62/22 |
| 4,883,517 | 11/1989 | Rathbone | 62/22 |
| 4,968,337 | 11/1990 | Layland et al. | 62/24 |
| 5,019,144 | 5/1991 | Victor et al. | 62/22 |
| 5,036,672 | 8/1991 | Rottmann | 62/24 |
| 5,049,173 | 9/1991 | Cormier, Sr. et al. | 62/22 X |
| 5,098,456 | 3/1992 | Dray et al. | 62/24 |
| 5,100,448 | 3/1992 | Lockett et al. | 62/24 |
| 5,114,449 | 5/1992 | Agrawal et al. | 62/22 |

OTHER PUBLICATIONS

Distillation of Air, R. E. Latimer, Chemical Engineering Progress, Feb., 1967, pp. 35-59.

*Primary Examiner*—Henry Bennett
*Assistant Examiner*—C. Kilner
*Attorney, Agent, or Firm*—Stanley Ktorides

[57] ABSTRACT

A direct sequenced three column cryogenic rectification system wherein material flow is unidirectional from higher to lower pressure through the system enabling high recovery of each of the three major components of feed air.

9 Claims, 3 Drawing Sheets

TRIPLE COLUMN CRYOGENIC RECTIFICATION SYSTEM

TECHNICAL FIELD

This invention relates generally to the cryogenic rectification of air and more particularly to the cryogenic rectification of air for the production of nitrogen, oxygen and argon.

BACKGROUND ART

Conventional cryogenic air separation processes that produce oxygen or oxygen and argon with nitrogen are commonly based on a dual pressure cycle. Air is first compressed and subsequently cooled by counter-current heat exchange with warming product streams. The cooled and compressed air is introduced into two fractionating zones, the first of which is at a pressure on the same order as that of the air. The first fractionating zone is thermally linked with a second fractionating zone which is at a lower pressure. The two zones are thermally linked such that a condenser of the first zone reboils the second zone. The air undergoes a partial separation in the first zone producing a substantially pure liquid nitrogen fraction and a liquid fraction enriched in oxygen.

The enriched oxygen fraction is an intermediate feed to the second fractionating zone. The substantially pure liquid nitrogen from the first fractionating zone is used as reflux at the top of the second fractionating zone. In this fractionating zone the separation is completed, producing substantially pure oxygen from the bottom of the zone and substantially pure nitrogen from the top.

When argon is produced in the conventional process, a third fractionating zone is employed. The feed to this zone is a vapor fraction enriched in argon which is withdrawn from an intermediate point in the second fractionating zone. The pressure of this third zone is of the same order as that of the second zone. In the third fractionating zone, the feed is rectified into an argon rich stream which is withdrawn from the top, and a liquid stream which is withdrawn from the bottom of the third fractionating zone and introduced to the second fractionating zone at an intermediate point.

Reflux for the third fractionating zone is provided by a condenser which is located at the top. In this condenser, argon enriched vapor is condensed by heat exchange from another stream, which is typically the enriched oxygen fraction from the first fractionating zone. The enriched oxygen stream then enters the second fractionating zone in a partially vaporized state at an intermediate point, above the point where the feed to third fractionating zone is withdrawn.

The separation of air, a ternary mixture, into nitrogen, argon and oxygen may be viewed as two binary separations. One binary separation is the separation of the high boiling point oxygen from the intermediate boiling point argon. The other binary separation is the separation of the intermediate boiling point argon from the low boiling point nitrogen. Of these two binary separations, the former is more difficult, requiring more reflux and/or theoretical trays than the latter. Argon-oxygen separation is the primary function of third fractionating zone and the bottom section of the second fractionating zone below the point where the feed to the third zone is withdrawn. Nitrogen-argon separation is the primary function of the upper section of the second fractionating zone above the point where the feed to the third fractionating zone is withdrawn.

The ease of separation is also a function of pressure. Both binary separations become more difficult at higher pressure. This fact dictates that for the conventional arrangement the optimal operating pressure of the second and third fractionating zones is at or near the minimal pressure of one atmosphere. For the conventional arrangement, product recoveries decrease substantially as the operating pressure is increased above one atmosphere mainly due to the increasing difficulty of the argon-oxygen separation.

There are other considerations, however, which make elevated pressure processing attractive. Distillation column diameters and heat exchanger cross sectional areas can be decreased due to increased vapor density. Elevated pressure products can provide substantial compression equipment capital cost savings.

In some cases, integration of the air separation process with a power generating gas turbine is desired. In these cases, elevated pressure operation of the air separation process is required. The air feed to the first fractionating zone is at an elevated pressure of approximately 10 to 20 atmospheres absolute. This causes the operating pressure of the second and third factionating zones to be approximately 3 to 6 atmospheres absolute. Operation of the conventional arrangement at these pressures results in very poor product recoveries due to the previously described effect of pressure on the ease of separation.

Accordingly, it is an object of this invention to provide a cryogenic rectification system which can produce nitrogen, oxygen and argon product by the cryogenic rectification of feed air with high product recoveries even at elevated pressure operation.

SUMMARY OF THE INVENTION

The above and other objects which will become apparent to one skilled in the art upon a reading of this disclosure are attained by the present invention, one aspect of which is:

A method for producing nitrogen, oxygen and argon product by the cryogenic rectification of air comprising:

(A) introducing feed air into a first column operating at a pressure within the range of from 150 to 350 psia and separating the feed air by cryogenic rectification within the first column into nitrogen-enriched vapor and oxygen-argon-enriched fluid;

(B) passing oxygen-argon-enriched fluid from the first column into a second column operating at a pressure less than that of the first column and having a bottom reboiler, and separating oxygen-argon-enriched fluid by cryogenic rectification within the second column into nitrogen-rich vapor and oxygen-argon-rich fluid;

(C) condensing nitrogen-enriched vapor by indirect heat exchange with oxygen-argon-rich fluid in the second column bottom reboiler to produce nitrogen-enriched liquid and oxygen-argon-rich vapor, employing nitrogen-enriched liquid as reflux liquid for the first column, and employing oxygen-argon-rich vapor as reflux vapor for the second column;

(D) passing oxygen-argon-rich fluid from the second column into a third column operating at a pressure less than that of the second column and having a bottom reboiler, and separating oxygen-argon-rich fluid by cryogenic rectification within the third column into argon-rich fluid and oxygen-rich fluid;

(E) recovering a first portion of nitrogen-rich vapor as product nitrogen;

(F) condensing a second portion of nitrogen-rich vapor by indirect heat exchange with oxygen-rich fluid in the third column bottom reboiler to produce nitrogen-rich liquid and oxygen-rich vapor, employing nitrogen-rich liquid as reflux liquid for the second column, and employing oxygen-rich vapor as reflux vapor for the third column; and (G) recovering oxygen-rich fluid as product oxygen and argon-rich fluid as product argon.

Another aspect of the invention is:

Apparatus for producing nitrogen, oxygen and argon product by cryogenic rectification comprising:

(A) a first column having feed introduction means;

(B) a second column having a bottom reboiler, means for passing fluid from the lower portion of the first column into the second column, and means for passing fluid from the upper portion of the first column into the second column bottom reboiler and from the second column bottom reboiler into the first column;

(C) means for recovering product from the second column;

(D) a third column having a bottom reboiler, means for passing fluid from the second column into the third column, and means for passing fluid from the upper portion of the second column into the third column bottom reboiler and from the third column bottom reboiler into the second column;

(E) means for recovering product from the lower portion of the third column; and (F) means for recovering product from the upper portion of the third column.

As used herein, the term "column" means a distillation or fractionation column or zone, i.e., a contacting column or zone wherein liquid and vapor phases are countercurrently contacted to effect separation of a fluid mixture, as for example, by contacting of the vapor and liquid phases on vapor-liquid contacting elements such as on a series of vertically spaced trays or plates mounted within the column and/or on packing elements which may be structured and/or random packing elements. For a further discussion of distillation columns, see the Chemical Engineers' Handbook. Fifth Edition, edited by R. H. Perry and C. H. Chilton, McGraw-Hill book Company, New York, Section 13, "Distillation", B. D. Smith, et al., page 13-3, *The Continuous Distillation Process.*

Vapor and liquid contacting separation processes depend on the difference in vapor pressures for the components. The high vapor pressure (or more volatile or low boiling) component will tend to concentrate in the vapor phase while the low vapor pressure (or less volatile or high boiling) component will tend to concentrate in the liquid phase. Distillation is the separation process whereby heating of a liquid mixture can be used to concentrate the volatile component(s) in the vapor phase and thereby the less volatile component(s) in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is adiabatic and can include integral or differential contact between the phases. Separation process arrangements that utilize the principles of rectification to separate mixtures are often interchangeably termed rectification columns, distillation columns, or fractionation columns. Cryogenic rectification is a rectification process carried out, at least in part, at low temperatures, such as at temperatures at or below 150° K.

As used herein, the term "indirect heat exchange" means the bringing of two fluid streams into heat exchange relation without any physical contact or intermixing of the fluids with each other.

As used herein, the term "feed air" means a mixture comprising primarily nitrogen, oxygen and argon such as air.

As used herein, the terms "upper portion" and "lower portion" mean those sections of a column respectively above and below the midpoint of the column.

As used herein, the term "tray" means a contacting stage, which is not necessarily an equilibrium stage, and may mean other contacting apparatus such as packing having a separation capability equivalent to one tray.

As used herein, the term "equilibrium stage" means a vapor-liquid contacting stage whereby the vapor and liquid leaving the stage are in mass transfer equilibrium, e.g. a tray having 100 percent efficiency or a packing element height equivalent to one theoretical plate (HETP).

As used herein, the term "top condenser" means a heat exchange device which generates column downflow liquid from column top vapor.

As used herein, the term "bottom reboiler" means a heat exchange device which generates column upflow vapor from column bottom liquid. A bottom reboiler may be physically within or outside a column. When the bottom reboiler is within a column, the bottom reboiler encompasses the portion of the column below the lowermost tray or equilibrium stage of the column.

DETAILED DESCRIPTION

The invention is a direct sequenced system wherein material flow is in one direction only, from a higher pressure to a lower pressure zone. This is in contrast to the conventional arrangement wherein material flow is bi-directional between zones such as between the argon sidearm column and the lower pressure column of a double column. The invention has particular utility in elevated pressure operation by producing product at relatively high recovery.

Figure 1:
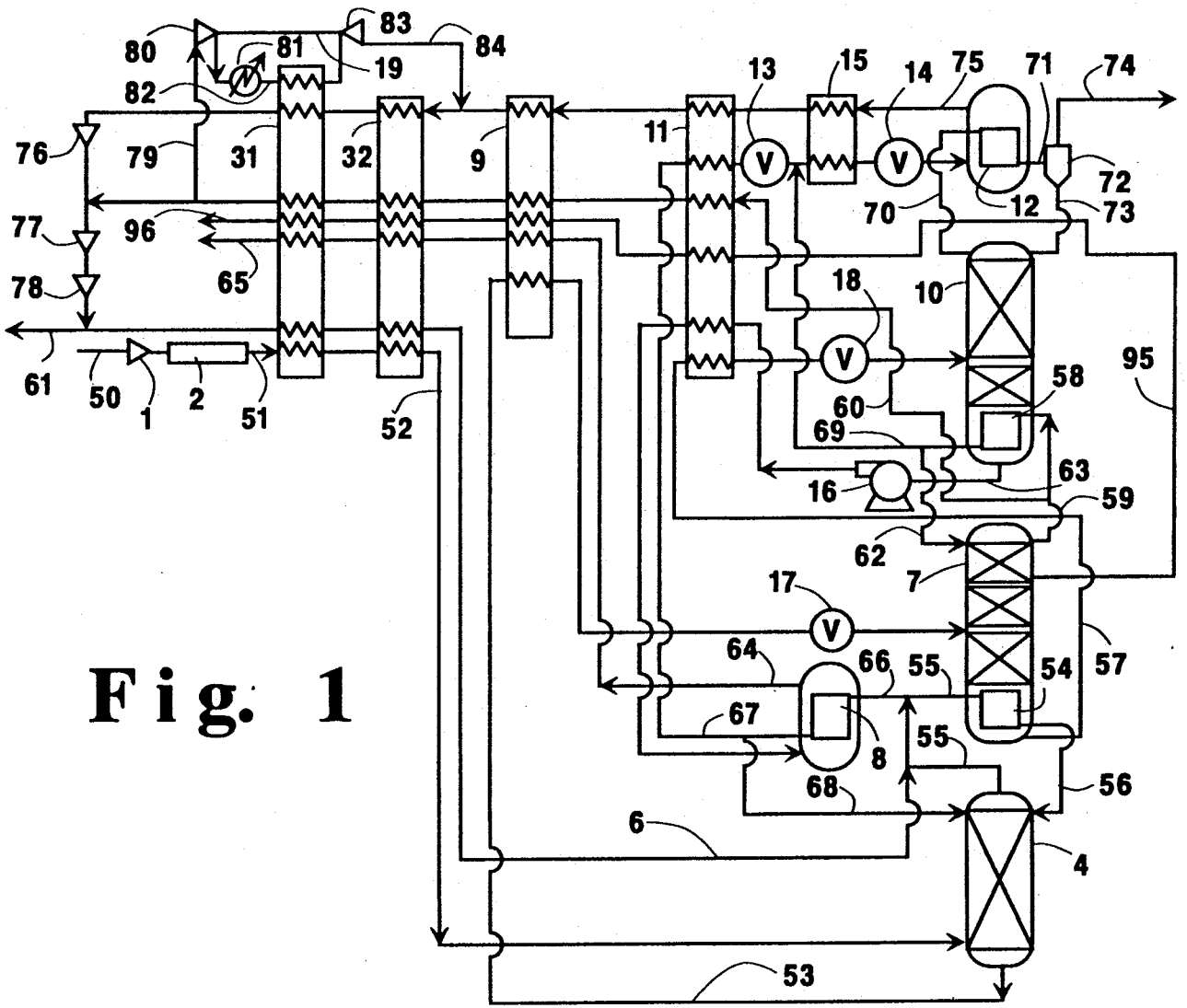
FIG. 1 is a schematic flow diagram of one preferred embodiment of the invention.

The invention will be described in detail with referenced to the Drawings. Referring now to FIG. 1, feed air 50 is compressed by passage through compressor 1 and cleaned of high boiling impurities such as carbon dioxide, water vapor and hydrocarbons by passage through purifier 2. Compressed, cleaned feed air 51 is then cooled by indirect heat exchange through heat exchangers 31 and 32 against return streams, and compressed, cleaned, cooled feed air 52 is passed into first column 4 which is operating at a pressure generally within the range of from 150 to 350 pounds per square inch absolute (psia) and preferably within the range of from 180 to 300 psia.

Within first column 4 the feed air is separated by cryogenic rectification into nitrogen-enriched vapor, having a nitrogen concentration exceeding that of the feed air, and oxygen-argon-enriched fluid, having a concentration of oxygen and argon which exceeds that of the feed air, and also containing nitrogen. Oxygen-argon enriched fluid is withdrawn from first column 4 as liquid stream 53, subcooled by indirect heat exchange with return streams in heat exchanger 9 and then passed through valve 17 and into second column 7 having bottom reboiler 54. Second column 7 is operating at a pressure less than that of first column 4. The operating pressure of first column 4 is a function of the operating pressure of second column 7, the composition of the fluids on both sides of bottom reboiler 54 and the thermal performance of bottom reboiler 54. The operating pressure of second column 7 is a function of the operating pressure of third column 10, the compositions of the fluids on both sides of bottom reboiler 58 and the thermal performance of bottom reboiler 58. Generally second column 7 is operating at a medium pressure within the range of from 40 to 105 psia, preferably within the range of from 50 to 95 psia.

Within second column 7 the oxygen-argon-enriched fluid is separated by cryogenic rectification into nitrogen-rich vapor, having a nitrogen concentration exceeding that of the oxygen-argon-enriched fluid, and into oxygen-argon-rich fluid, having a concentration of oxygen and argon which exceeds that of the oxygen-argon-enriched fluid introduced into second column 7. Nitrogen-enriched vapor is passed from first column 4 as stream 55 into bottom reboiler 54 wherein it is condensed by indirect heat exchange with boiling oxygen-argon-rich fluid to produce nitrogen-enriched liquid and oxygen-argon-rich vapor. Nitrogen-enriched liquid is passed from bottom reboiler 54 into first column 4 as stream 56 and is employed in first column 4 as reflux liquid. Oxygen-argon-rich vapor is passed up second column 7 as reflux vapor.

Oxygen-argon-rich fluid is withdrawn from second column 7 as liquid stream 57, subcooled by indirect heat exchange with return streams in heat exchanger 11 and then passed through valve 18 and into third column 10 having bottom reboiler 58. Third column 10 is operating at a pressure less than that of second column 7. Generally third column 10 is operating at a pressure within the range of from 12 to 25 psia. The lower limit for the operating pressure of third column 10 is set by the need to avoid freezing in top condenser 12. Within third column 10 the oxygen-argon-rich fluid is separated by cryogenic rectification into argon-rich fluid, having an argon concentration exceeding that of the oxygen-argon-rich fluid, and into oxygen-rich fluid, having an oxygen concentration exceeding that of the oxygen-argon-rich fluid introduced into third column 10.

Nitrogen-rich vapor is passed out of second column 7 as stream 59. A portion 60 of the nitrogen-rich vapor may be recovered as nitrogen product. Recovering as product means removal from the system and includes actual recovery as product as well as release to the atmosphere. There may be instances when one or more of the products produced by the invention is not immediately required and releasing this product to the atmosphere is less costly than storage. In the embodiment illustrated in FIG. 1, stream 60 is warmed by indirect heat exchange through heat exchangers 11, 9, 32 and 31 and is recovered as nitrogen product 61. Nitrogen product in stream 60 may be recovered at any point after passage through heat exchanger 31. Generally the nitrogen product will have a purity of at least 90 percent, preferably at least 99 percent. Generally the nitrogen product flowrate will be within 5 to 40 percent of that of the feed air. FIG. 1 also illustrates the use of a product purity control method wherein a gaseous nitrogen-containing stream 95 is withdrawn from an intermediate point of second column 7, warmed by passage through heat exchangers 9, 32 and 31 and passed out of the system as stream 96. The embodiment illustrated in FIG. 1 includes a nitrogen heat pump circuit which employs nitrogen-rich fluid. This nitrogen heat pump circuit will be described in detail later.

Nitrogen-rich vapor 59 is passed into bottom reboiler 58 wherein it is condensed by indirect heat exchange with boiling oxygen-rich fluid to produce nitrogen-rich liquid and oxygen-rich vapor. Nitrogen-rich liquid is passed from bottom reboiler 58 into second column 7 as stream 62 and is employed in second column 7 as reflux liquid. Oxygen-rich vapor is passed up third column 10 as reflux vapor. If desired, a portion of nitrogen-rich stream 62 may be recovered as product nitrogen. Such a portion may be in addition to stream 60 or it may be in place of stream 60 as the recovery of nitrogen-rich vapor as product nitrogen.

Oxygen-rich fluid is withdrawn from the lower portion of third column 10 as liquid stream 63. In the embodiment illustrated in FIG. 1 an oxygen product boiler is employed which enables the recovery of oxygen product at a higher pressure. In this embodiment stream 63 is pumped to a higher pressure through pump 16, warmed by passage through heat exchanger 11 and passed into oxygen product boiler 8 wherein it is vaporized by indirect heat exchange with condensing nitrogen-enriched vapor. Resulting oxygen vapor stream 64 is passed out of oxygen product boiler 8, is warmed by passage through heat exchangers 9, 32 and 31 as is recovered as product oxygen 65 having a purity of from 98 to 99.9995 percent and at a recovery within the range of from 90 to 100 percent.

As mentioned, oxygen product boiler 8 is driven by condensing nitrogen-enriched vapor. A portion 66 of nitrogen-enriched vapor stream 55 is passed into oxygen product boiler 8 wherein it is condensed by indirect heat exchange with the boiling oxygen-rich liquid. Resulting nitrogen-enriched liquid 67 is subcooled through heat exchanger 11, passed through valve 13, further subcooled through heat exchanger 15 and then passed through valve 14 and into top condenser 12. A portion 68 of the nitrogen-enriched liquid from oxygen product boiler 8 may be passed into first column 4 as additional liquid reflux. A portion 69 of nitrogen-rich liquid from bottom reboiler 58 is also subcooled through heat exchanger 15 and passed through valve 14 into top condenser 12.

Argon-rich fluid is withdrawn from third column 10 as vapor stream 70 and is passed into top condenser 12 wherein it is partially condensed by indirect heat exchange with vaporizing nitrogen-enriched and nitrogen-rich liquid. Resulting argon-rich fluid 71 is passed into phase separator 72 from which argon-rich liquid 73 is passed into third column 10 as reflux liquid and from which argon-rich vapor stream 74 is withdrawn and recovered as product argon having a purity within the range of from 85 to 99.995 percent at a recovery of from 65 to 99 percent. If desired argon product may be taken upstream of top condenser 12 by recovering, for example, a portion of stream 70.

Nitrogen vapor resulting from the heat exchange in top condenser 12 is passed out of top condenser 12 as stream 75 warmed by passage through heat exchangers 15, 11, 9, 32 and 31 and passed out of the system. In the embodiment illustrated in FIG. 1, warmed stream 75 is compressed by compressor 76 and then combined with stream 60. This combined stream is compressed through compressors 77 and 78 and then recovered as the aforementioned nitrogen product stream 61.

As mentioned previously, the embodiment illustrated in FIG. 1 employs a nitrogen heat pump circuit which may be employed to improve the argon recovery. The nitrogen heat pump circuit comprises the recycle of a portion of nitrogen stream 60 as shown as stream 6 in FIG. 1. If employed, nitrogen recycle stream 6 may have a flowrate up to 25 percent of that of the feed air. In the generation of refrigeration for the system, stream 79 is taken from stream 60, is compressed through compressor 80, and the heat of compression is removed by passage through cooler 81. Compressed stream 82 is cooled through heat exchanger 31 and expanded through expander 83 to generate refrigeration. Expander 83 serves to drive compressor 80 by means of coupling 19. Resulting expanded stream 84 is then passed into stream 75 and serves to pass refrigeration into the incoming feed air by passage through heat exchangers 32 and 31. A portion of the compressed nitrogen product from compressor 78 is passed as stream 6 through heat exchangers 31 and 32 for cooling. Thereafter cooled nitrogen stream 6 is passed into bottom reboiler 54, for example as part of stream 55. This produces a more favorable reflux ratio in second column 7 which reduces the argon losses in the top streams exiting second column 7 and thus improves the argon recovery.

The following example describes a computer simulation of the invention carried out in accord with the embodiment illustrated in FIG. 1. The example is presented for illustrative purposes and is not intended to be limiting.

EXAMPLE

The steady-state performance of the embodiment of the invention depicted in FIG. 1 was simulated using column pressure drops typical of structured packing. The pressure at the top of the low pressure or third column is 15 psia. Air is first compressed to a pressure of approximately 200 psia. The air is then cleaned, dried and cooled before entering the high pressure or first column at a pressure of 194 psia. A cooled gaseous nitrogen stream, which is recycled from the product nitrogen, is passed into bottom reboiler 54 along with first column top vapor. The recycled flowrate is 4.9 percent of the air feed flowrate. The high pressure column contains 65 theoretical stages. The liquid nitrogen flow exiting the top of the high pressure column from bottom reboiler 54 is 45 percent of the air feed, and contains 5 parts per million (ppm) of oxygen.

The balance of the feed to column 4 exits at the bottom as oxygen-argon-enriched liquid. The bottoms product is then subcooled before being throttled to the medium pressure or second column 7 pressure of 63 psia, and introduced into column 7 which contains 75 theoretical stages. The feed is introduced 20 theoretical stages from the bottom. The bottoms product of column 7 is a saturated oxygen-argon-rich liquid containing oxygen and 4 mole percent argon and about 40 ppm nitrogen. The bottoms flowrate is 22 percent of the air feed flowrate.

The flowrate of the gaseous nitrogen product stream 60 that is taken from the top of the medium pressure rectifier is 25 percent of the air feed flowrate. It contains 1 ppm of oxygen. It is warmed by heat exchangers 11, 9, 32 and 31 exiting heat exchanger 31 at a pressure of 62 psia. This represents 32 percent recovery of the nitrogen contained in the feed air.

The flowrate of the liquid nitrogen exiting bottom reboiler 58 determines the reflux ratio in the third column. Here the flowrate is 13 percent of the air feed flowrate. This stream is then mixed with stream 67 and the combined stream passes through valve 14 and into top condenser 12, where it boils at a pressure of 36 psia, providing reflux for column 10. The resulting vapor is warmed and, at a flowrate of 58 percent of the feed air flowrate, exits heat exchanger 31, at a pressure of 33 psia.

The bottoms product of column 7 is then subcooled before being throttled to the third column 10 pressure of 15 psia, and introduced into third column 10. Third column 10 contains 60 theoretical stages and the feed is introduced 25 theoretical stages from the bottom. The bottoms product of third column 10 is a saturated oxygen-rich liquid containing 99.74 percent oxygen with the remainder being argon. The bottoms flowrate is 21 percent of the air feed flowrate. This bottoms product is then pumped to 63 psia, warmed in heat exchanger 11, and vaporized in oxygen product boiler 8. The resulting gaseous oxygen is warmed in heat exchangers 9, 32 and 31, and exits at a pressure of 62 psia. This represents 99.9 percent recovery of the oxygen contained in the feed air.

The top product stream exiting top condenser 12 is a gaseous argon-rich stream containing 2 mole percent oxygen and 0.05 mole percent nitrogen. The flowrate of this stream is 0.84 percent of the air flowrate. This represents 88 percent recovery of the argon contained in the feed air.

The refrigeration production scheme depicted in FIG. 1 is one of many configurations that could be implemented. The present invention is independent of the method of refrigeration production. In this example, refrigeration is produced using a mechanically coupled turbine/booster unit coupled by coupling 19. To produce refrigeration, a portion of the 62 psia nitrogen product stream is compressed, cooled and expanded to a pressure of 35 psia, mixing with the other nitrogen stream before entering the cold end of heat exchanger 32. The molar flowrate of the expanded stream is 4.7 percent of the air flowrate.

Figure 2:
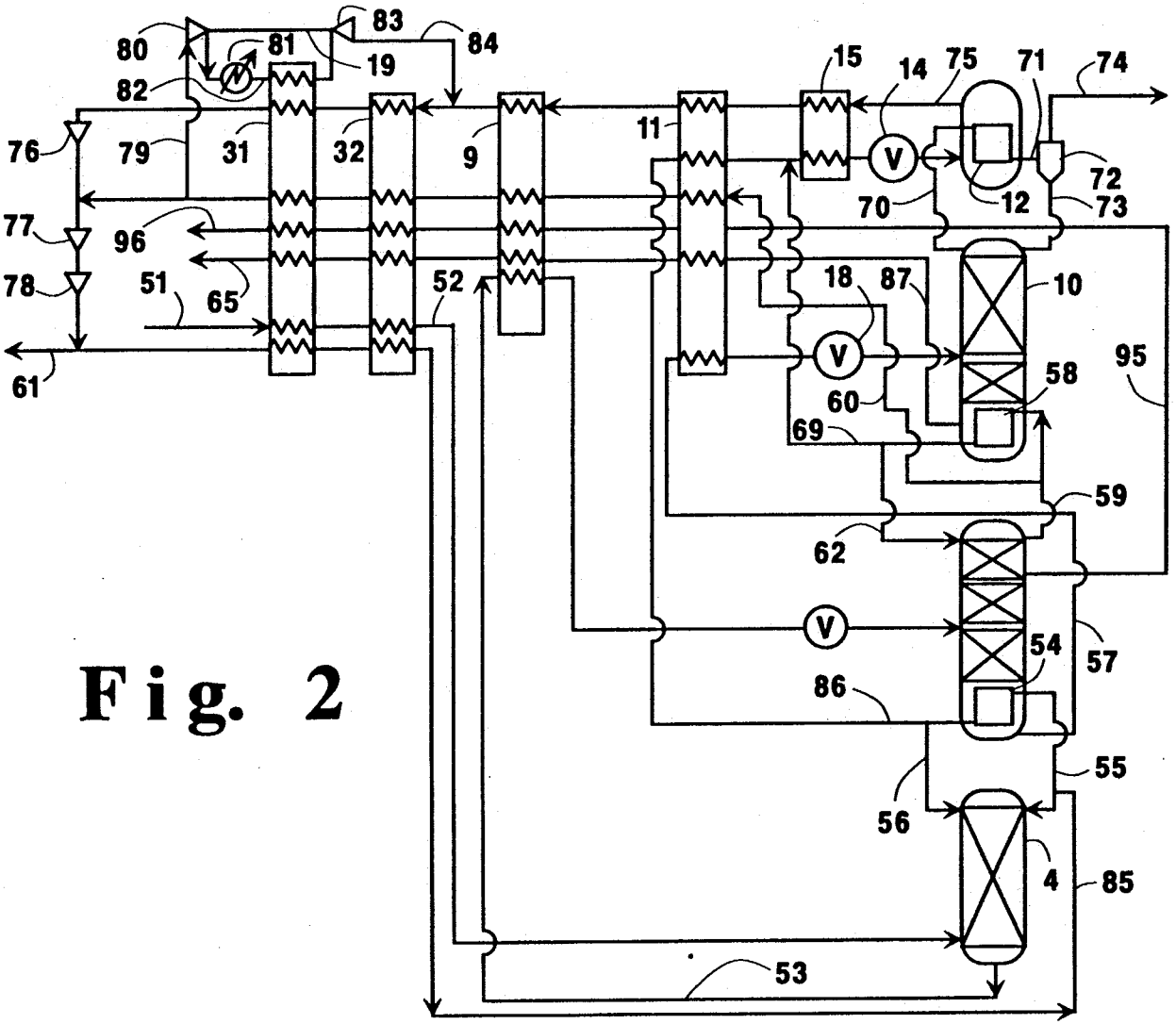
FIG. 2 is a schematic flow diagram of another preferred embodiment of the invention additionally comprising product recovery from the highest pressure column.

FIG. 2 illustrates another embodiment of the invention wherein some nitrogen product is additionally produced directly from the first column. In the embodiment illustrated in FIG. 2 the oxygen product boiler is not employed. The numerals in FIG. 2 correspond to those of FIG. 1 for the common elements and these common elements will not be described again in detail. Referring now to FIG. 2, a portion 85 of high pressure nitrogen-enriched vapor stream 55 is passed out from the column system through heat exchangers 32 and 31 and is recovered as part of nitrogen product stream 61.

A portion 86 of nitrogen-enriched liquid stream 56 from bottom reboiler 54 is passed through heat exchangers 11 and 15, through valve 14 and into top condenser 12. In this embodiment oxygen-rich fluid is withdrawn from the lower portion of column 10 as vapor stream 87 which is warmed by passage through heat exchangers 11, 9, 32 and 31 and is recovered as oxygen product stream 65.

Figure 3:
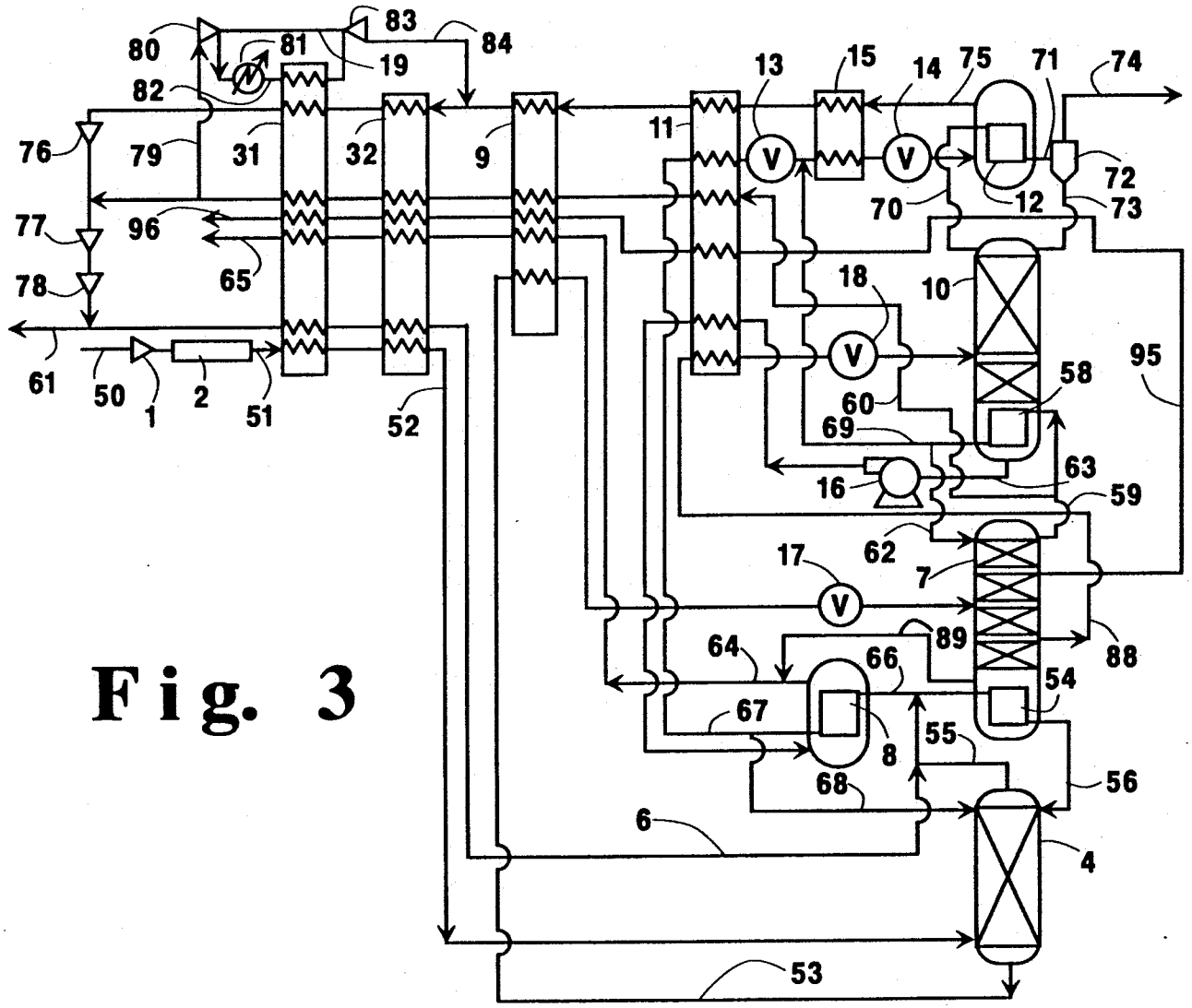
FIG. 3 is a schematic flow diagram of another preferred embodiment of the invention additionally comprising some oxygen product recovery from the medium pressure column.

FIG. 3 illustrates another embodiment of the invention wherein some oxygen product is additionally produced directly from the second column. The numerals in FIG. 3 correspond to those of FIG. 1 for the common elements and these common elements will not be described again in detail. Referring now to FIG. 3, an oxygen-argon-rich fluid stream 88 is taken from an intermediate section of second column 7 and is passed through heat exchanger 11 and valve 18 and fed into third column 10. An oxygen-containing vapor stream 89 is taken from second column 7 from a point at least one tray or equilibrium stage below the point from which stream 88 is withdrawn from second column 7. Stream 89 is passed into stream 64 taken from oxygen product boiler 8 and this stream is passed through heat exchangers 9, 32 and 31 and recovered as oxygen product stream 65.

Although the invention has been described in detail with reference to certain preferred embodiments, those skilled in the art will recognize that there are other embodiments of the invention within the spirit and the scope of the claims.

I claim:

1. A method for producing nitrogen, oxygen and argon product by the cryogenic rectification of air comprising:

(A) introducing feed air into a first column operating at a pressure within the range of from 150 to 350 psia and separating the feed air by cryogenic rectification within the first column into nitrogen-enriched vapor and oxygen-argon-enriched fluid;

(B) passing oxygen-argon-enriched fluid from the first column into a second column operating at a pressure less than that of the first column and having a bottom reboiler, and separating oxygen-argon-enriched fluid by cryogenic rectification within the second column into nitrogen-rich vapor and oxygen-argon-rich fluid;

(C) condensing nitrogen-enriched vapor by indirect heat exchange with oxygen-argon-rich fluid in the second column bottom reboiler to produce nitrogen-enriched liquid and oxygen-argon-rich vapor, employing nitrogen-enriched liquid as reflux liquid for the first column, and employing oxygen-argon-rich vapor as reflux vapor for the second column;

(D) passing oxygen-argon-rich fluid from the second column into a third column operating at a pressure less than that of the second column and having a bottom reboiler, and separating oxygen-argon-rich fluid by cryogenic rectification within the third column into argon-rich fluid and oxygen-rich fluid;

(E) recovering a first portion of nitrogen-rich vapor as product nitrogen;

(F) condensing a second portion of nitrogen-rich vapor by indirect heat exchange with oxygen-rich fluid in the third column bottom reboiler to produce nitrogen-rich liquid and oxygen-rich vapor, employing nitrogen-rich liquid as reflux liquid for the second column, and employing oxygen-rich vapor as reflux vapor for the third column; and (G) recovering oxygen-rich fluid as product oxygen and argon-rich fluid as product argon.

2. The method of claim 1 wherein the oxygen-rich fluid is increased in pressure and vaporized by indirect heat exchange with condensing nitrogen-enriched vapor prior to recovery.

3. The method of claim 1 wherein nitrogen-rich vapor is condensed prior to recovery.

4. The method of claim 1 additionally comprising recovering nitrogen-containing fluid taken from the first column.

5. The method of claim 1 additionally comprising recovering oxygen-containing fluid taken from the second column.

6. Apparatus for producing nitrogen, oxygen and argon product by cryogenic rectification comprising:

(A) a first column having feed introduction means;

(B) a second column having a bottom reboiler, means for passing fluid from the lower portion of the first column into the second column, and means for passing fluid from the upper portion of the first column into the second column bottom reboiler and from the second column bottom reboiler into the first column;

(C) means for recovering product from the second column;

(D) a third column having a bottom reboiler, means for passing fluid from the second column into the third column, and means for passing fluid from the upper portion of the second column into the third column bottom reboiler and from the third column bottom reboiler into the second column;

(E) means for recovering product from the lower portion of the third column; and (F) means for recovering product from the upper portion of the third column.

7. The apparatus of claim 6 wherein the means for recovering product from the lower portion of the third column includes a pump and a product boiler.

8. The apparatus of claim 6 further comprising means for recovering product from the upper portion of the first column.

9. The apparatus of claim 6 further comprising means for recovering additional product from the second column wherein said means for recovering additional product communicates with the second column at a point below the point from which the means for passing fluid from the second column into the third column communicates with the second column.

* * * * *